US008939759B2

(12) United States Patent
Mori

(10) Patent No.: US 8,939,759 B2
(45) Date of Patent: Jan. 27, 2015

(54) TUBULAR BURNER

(75) Inventor: Keisuke Mori, Nagoya (JP)

(73) Assignee: Rinnai Corporation, Aichi (JP)

( * ) Notice: Subject to any disclaimer, the term of this patent is extended or adjusted under 35 U.S.C. 154(b) by 595 days.

(21) Appl. No.: 13/278,267

(22) Filed: Oct. 21, 2011

(65) Prior Publication Data

US 2013/0101947 A1 Apr. 25, 2013

(51) Int. Cl.
*F23D 14/08* (2006.01)
*F23D 14/26* (2006.01)

(52) U.S. Cl.
CPC ..... *F23D 14/08* (2013.01); *F23D 14/26* (2013.01)
USPC ..... 431/354; 431/114; 431/346; 431/281; 431/266; 431/286

(58) Field of Classification Search
CPC ..... F23Q 9/00; F23Q 3/00; F23D 14/08; F23D 14/46; F23D 14/62
USPC ..... 431/354, 266, 286, 114, 281; 126/92 R
See application file for complete search history.

(56) References Cited

U.S. PATENT DOCUMENTS

| | | | | | |
|---|---|---|---|---|---|
| 2,462,704 | A * | 2/1949 | Zink | ..... | 239/543 |
| 2,905,235 | A * | 9/1959 | Dolby | ..... | 431/349 |
| 3,695,818 | A * | 10/1972 | Mizutani | ..... | 431/328 |
| 4,887,963 | A * | 12/1989 | LeMer | ..... | 431/354 |
| 5,186,620 | A | 2/1993 | Hollingshead | | |
| 5,562,440 | A * | 10/1996 | Rodgers | ..... | 431/328 |
| 6,478,577 | B1 * | 11/2002 | Maricic et al. | ..... | 431/353 |
| 6,857,868 | B1 * | 2/2005 | Li et al. | ..... | 431/266 |
| 7,204,688 | B2 * | 4/2007 | Han | ..... | 431/354 |

* cited by examiner

*Primary Examiner* — Steven B McAllister
*Assistant Examiner* — Nikhil Mashruwala
(74) *Attorney, Agent, or Firm* — Cermak Nakajima & McGowan LLP; Tomoko Nakajima

(57) ABSTRACT

A tubular burner has: a mixing tube inclusive of an inlet port, a venturi section, and a tapered tube section; and a flame hole member having a plurality of flame holes and being adapted to be fitted into a front end region of the mixing tube. A flame hole member has a front plate and a rear plate, both of sheet metal make. The front plate has a first flame hole in the central portion of the front plate, and a plurality of second flame holes located around a periphery of the first flame hole. The rear plate has a first ventilation hole in the center thereof so as to lie opposite to the first flame hole, and a plurality of second ventilation holes of smaller diameter than the first ventilation hole.

3 Claims, 4 Drawing Sheets

TUBULAR BURNER

BACKGROUND

1. Technical Field

The present invention relates to a tubular burner having; a mixing tube including at a rear end thereof an inlet port into which a fuel gas and primary air flow; a venturi section having a smaller diameter than the diameter of the inlet port; and a tapered tube section having a gradually larger diameter from the venturi section toward a front of the mixing tube. The tubular burner has a flame hole member with a plurality of flame holes, the flame hole member being adapted to be fitted into a front end region of the mixing tube.

2. Background Art

As this kind of burner, there is conventionally known one which is described in U.S. Pat. No. 5,186,620. In the burner as described therein, a flame hole member is made of a sintered metal of larger thickness. A plurality of flame holes which penetrate in the forward and backward (i.e., longitudinal) direction are formed in the flame member so that a mixture of a fuel gas and primary air (hereinafter also referred to as air-gas mixture) is ejected from these flame holes for combustion.

The flow of the air-gas mixture that flows from the mixing tube toward the flame hole member has a directional component that is directed radially outward under the influence of the tapered tube section. Therefore, if the flame hole member is made smaller in thickness, the flame is more likely to get spread radially outward. In the above-mentioned conventional burner, on the other hand, since the flame hole member has a larger thickness, the flow of the air-gas mixture is rectified at each of the flame holes so as to be directed forward, thereby preventing the flames from getting spread radially outward.

However, in the above-mentioned conventional burner, the flame hole member is made of a sintered metal of higher material cost, thereby bringing about a disadvantage of higher cost.

SUMMARY

Problems to be Solved by the Invention

In view of the above points, this invention has a problem of providing a tubular burner in which a flame hole member is made of an inexpensive sheet metal material to thereby reduce the cost, and in which the flames can be prevented from getting spread radially outward.

Means for Solving the Problems

In order to solve the above problems, the tubular burner according to this invention comprises: a mixing tube inclusive of an inlet port, at a rear end thereof, into which a fuel gas and primary air flow, a venturi section having a smaller diameter than a diameter of the inlet port, and a tapered tube section having a gradually larger diameter from the venturi section toward a front of the mixing tube; and a flame hole member having a plurality of flame holes and being adapted to be fitted into a front end region of the mixing tube such that a mixture of the fuel gas and primary air is ejected from the flame holes for combustion. The flame hole member is made up of a front plate of sheet metal make, and a rear plate of sheet metal make located at a rear of the front plate. The front plate has a first flame hole in the central portion of the front plate, and a plurality of second flame holes located around a periphery of the first flame hole. The first flame hole is formed into a cylindrical shape protruding beyond a front face of the front plate. The rear plate has: a first ventilation hole in a center thereof so as to lie opposite to the first flame hole; and a plurality of second ventilation holes of smaller diameter than the first ventilation hole. The second ventilation holes are located toward a periphery of the rear plate at a predetermined radial distance from the first ventilation hole. A hole-free portion is formed in such a portion of the rear plate as to be present between the first ventilation hole and the second ventilation holes.

According to this invention, the flame hole member is made of the front plate and the rear plate, i.e., a total of two plates, of metal plate make. Therefore, as compared with the above-mentioned conventional example in which the flame hole member made of a sintered metal is used, the cost can be reduced. In addition, according to this invention, although the flame hole member is made of sheet metal plates, the flames can be prevented from getting spread in a radially outward direction.

In other words, according to this invention, the first flame hole in the central portion of the front plate is formed into a cylindrical shape (i.e., a shape like a tube). Therefore, the flow of the air-gas mixture to be ejected from the first flame hole is rectified so as to be directed forward and, as a result of the combustion of this air-gas mixture, there will be formed a central flame that is largely elongated in the forward direction. Accordingly, the flow velocity of the central flame becomes higher than the flow velocity of the surrounding flames that are formed by the combustion of the air-gas mixture ejected from the second flame holes that are smaller than the first flame hole. As a result, the surrounding flames are attracted toward the central flame, and the flames can thus be prevented from getting spread radially outward.

By the way, if the amount of protrusion of the first flame hole beyond the front face of the front plate is made large, the amount of heat to be inputted from the surrounding flames into a cylindrical section (i.e., the section like a tube) of the first flame hole becomes large, whereby back firing is likely to occur due to overheating of the first flame hole. According to this invention, on the other hand, there is provided a hole-free portion between the first ventilation hole and the second ventilation holes in the rear plate. As a result, the flow of the air-gas mixture that flows from the first ventilation hole toward the first flame hole comes to be less influenced by the flow of the air-gas mixture that comes in from the second ventilation holes. The air-gas mixture therefore comes to flow substantially straight from the first ventilation hole toward the first flame hole. Therefore, even if the amount of protrusion of the first flame hole beyond the front face of the front plate is made smaller, the flow of the air-gas mixture ejected from the first flame hole is rectified so as to be directed forward. There can thus be obtained an effect in that the above-mentioned outward spreading of the flames can effectively be prevented. Accordingly, the amount of protrusion of the first flame hole beyond the front face of the front plate can be minimized to the extent possible and, consequently, the backfiring due to overheating of the first flame hole can be prevented.

Preferably, a plurality of the second flame holes are respectively formed on different-diameter circles which are coaxial with the first flame opening, and a portion in which the second ventilation holes are formed in the rear plate is located radially outside the circle of smallest diameter among the coaxial circles. According to this arrangement, the gas-air mixture can be prevented from being ejected out of the second flame holes accompanied by the directional component toward the radially outward direction. In this manner, the flames can more effectively be prevented from getting spread in the radially outward direction.

DETAILED DESCRIPTION OF PREFERRED EMBODIMENTS

Figure 1:
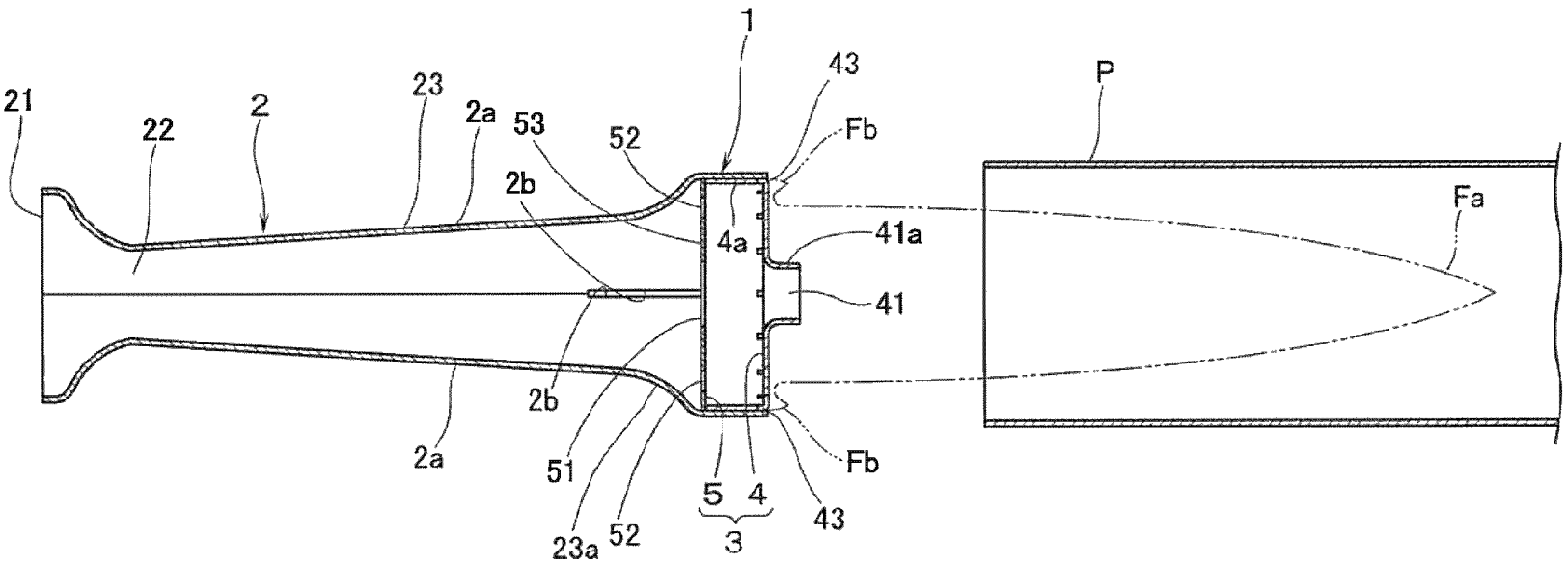
FIG. 1 is a sectional side view of a burner according to an embodiment of this invention.

In FIG. 1 reference numeral 1 denotes a tubular burner according to an embodiment of this invention. This burner 1 is intended for use as a heating source in a heating appliance and is disposed so as to lie opposite to an inlet end of a heat exchange pipe P which performs heat exchanging with room air.

Figure 2:
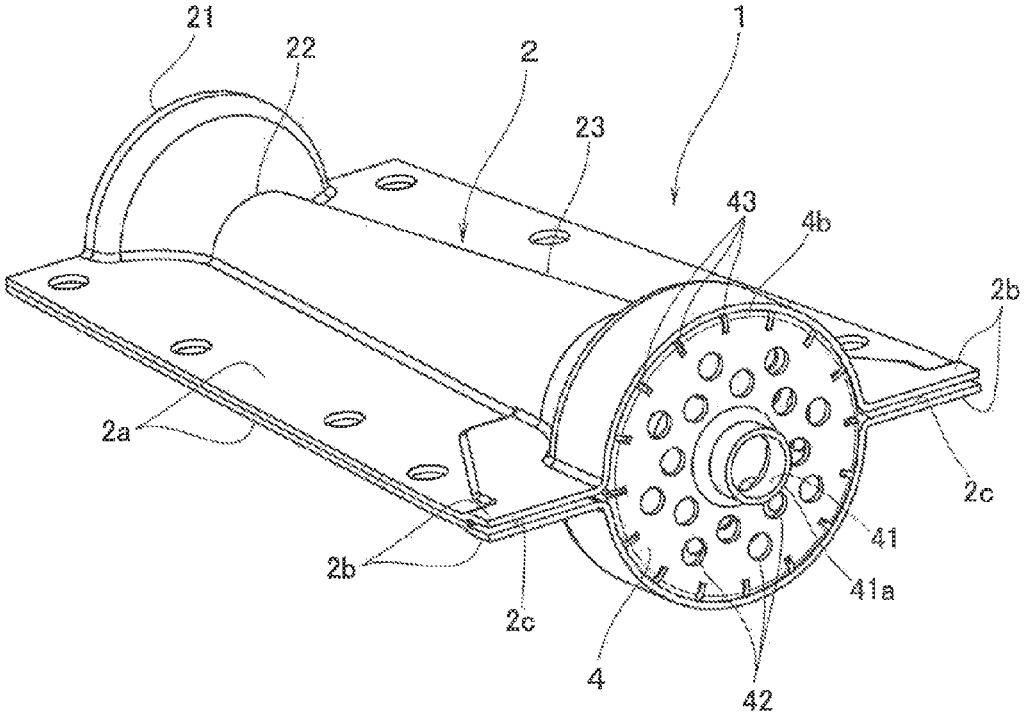
FIG. 2 is a perspective view of the burner according to the embodiment of this invention.
Figure 3:
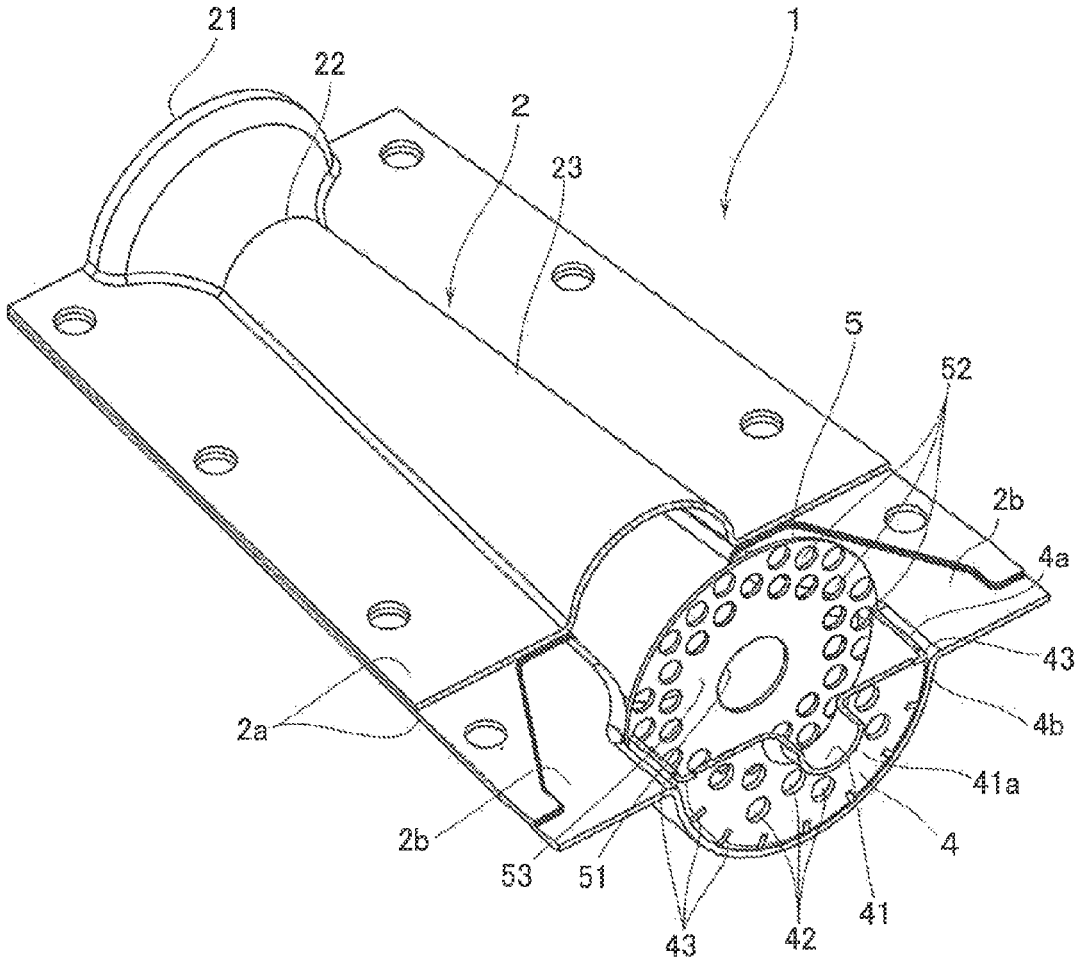
FIG. 3 is a partially cut-away perspective view of the burner according to the embodiment of this invention.

The burner 1 is made up of a mixing tube 2, and a flame hole member 3 which is adapted to be fitted into a front end region of the mixing tube 2. Also with reference to FIGS. 2 and 3, the mixing tube 2 has: an inlet port 21 at a rear end thereof; a venturi section 22 which is reduced in diameter relative to the inlet port 21; and a tapered tube section 23 which is gradually increased in diameter from the venturi section 22 forward. In this arrangement, a fuel gas injected from a gas nozzle (not illustrated) which is disposed in a manner to face the inlet port 21, and primary air flow from the inlet port 21 into the mixing tube 2 so that a mixture of fuel gas and primary air is generated within the mixing tube 2. The mixing tube 2 is of a sheet metal make, and is formed by combining together two sheet metal plates 2*a*, 2*a* made, e.g., of press-formed stainless steel, and the like.

Although not illustrated, a plurality of the tubular burners 1 are disposed in parallel with one another. At the front end region of the two sheet metal plates 2*a*, 2*a* that constitute the mixing tube 2, there are formed dented portions 2*b* in a manner to be away from the other sheet metal plate 2*a*. The clearance to be generated, on diametrically opposite positions, between the two sheet metal plates 2*a*, 2*a* by means of the respective dented portions 2*b* constitutes a slit-shaped carry-over flame hole 2*c* which causes flames to be carried over to the adjoining burners.

The front end region of the mixing tube 2 is formed into a cylindrical shape which is elongated forward from an enlarged-diameter region 23*a* of a curved shape at the front end of the tapered tube section 23. The flame hole member 3 to be fitted into the front end region of the mixing tube 2 is constituted by a front plate 4 which is formed of a sheet metal plate of stainless steel make and the like, and a disk shaped rear plate 5 which is formed of a sheet metal plate of stainless steel make and the like and which is located rearward of the front plate 4.

Figure 4:
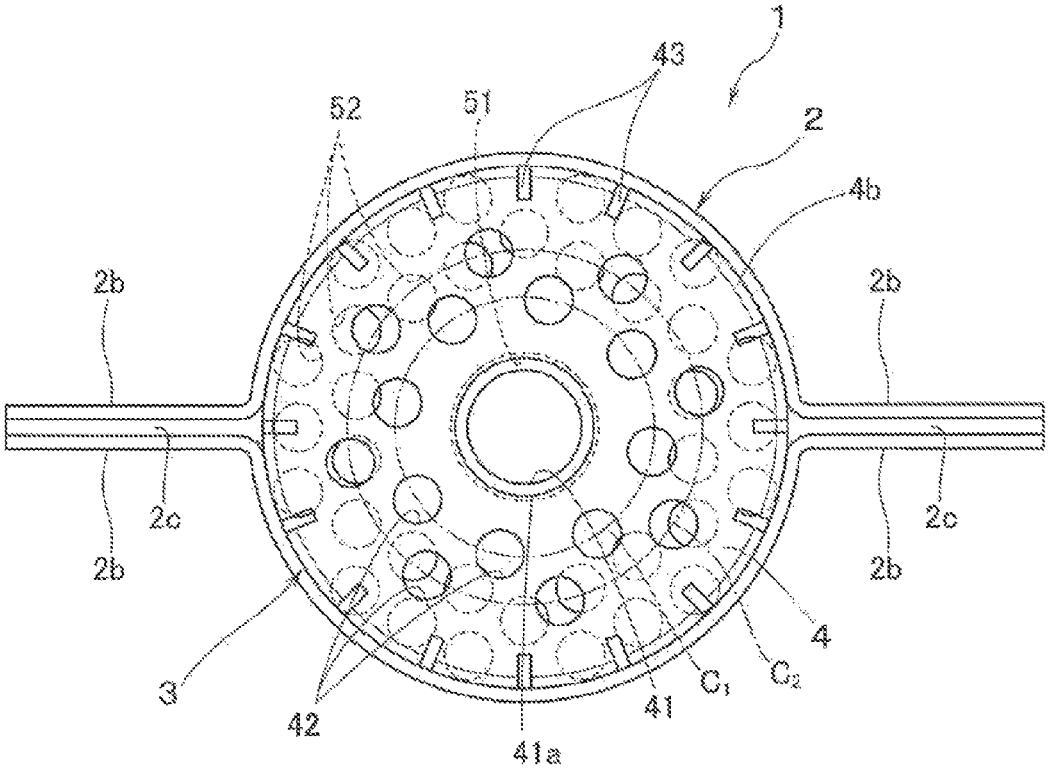
FIG. 4 is a front view as seen from the front of the burner according to the embodiment of this invention.

The front plate 4 has a tubular member 4*a* which is elongated backward from the periphery of the disk shaped front surface portion of the front plate 4 so as to be fitted into the inner circumference at the front end region of the mixing tube 2. The front plate 4 is provided with: a first flame hole 41 which is formed in the central portion of the front plate; and a plurality of second flame holes 42 which are smaller than the first flame hole 41 and which are located around the periphery of the first flame hole 41. As shown in FIG. 4, in this embodiment, a total of eight second flame holes 42 are formed respectively on an inner-side circle and an outer-side circle, i.e., two different-diameter circles $C_1$, $C_2$ in coaxial relationship with the first flame hole 41. The two groups of the second flame holes 42 are deviated from each other by half a pitch in circumferential location. Alternatively, a plurality of second flame holes 42 may be formed respectively on three or more circles that are coaxial with the first flame hole 41. Further, in a rounded corner section 4*b* between the front face portion of the front plate 4 and the tubular member 4*a*, there are formed a plurality of flame retention holes 43 in a slit shape at a circumferential distance from one another.

In the central portion of the rear plate 5 there is formed a first ventilation hole 51 of a diameter equivalent to that of the first flame hole 41 in a manner to lie opposite to the first flame hole 41. In addition, toward a peripheral portion of the rear plate 5 at a predetermined radial distance from the first ventilation hole 51, there are formed a plurality of second ventilation holes 52 which are smaller than the first ventilation hole 51. As shown in FIG. 4, in this embodiment, in that peripheral portion of the rear plate 5 which lies on a radially outside of the innermost coaxial circle $C_1$ that is the smallest among the above-mentioned coaxial circles, there are formed eighteen second ventilation holes 52 on the inside and on the outside in a manner to locate on inside and outside dual equilateral hexagons, respectively, while positionally deviating from one another in the circumferential direction by half a pitch. Alternatively, a plurality of second ventilation holes 52 may be formed toward a peripheral portion of the rear plate 5 in a manner to be positioned on coaxial circles of different diameters. Further, in that portion of the rear plate 5 which lies between the first ventilation hole 51 and the inner-side second ventilation holes 52, there is formed a hole-free portion 53 in which there is formed no hole.

According to the above-mentioned tubular burner 1 of this embodiment, the flame hole member 3 is constituted by the front and rear, i.e., a total of two, sheet metal plates 4, 5. Therefore, as compared with the conventional example in which a flame hole member made of a sintered metal is used, the cost can be reduced. Further, if the flame hole member 3 is made of a sheet metal plate, the air-gas mixture is ejected with a directional component that is directed in a radially outward direction under the influence of the tapered tube section 23 of the mixing tube 2, and the flames are likely to get spread in the radially outward direction. However, in this embodiment, the flames can be prevented from spreading radially outward, whereby the flames can surely be sent to the heat exchange pipe P. A description will now be made of the reasons.

According to this embodiment, the first flame hole 41 in the central portion of the front plate 4 is formed into a cylindrical shape. Therefore, the flow of the air-gas mixture ejected from the first flame hole 41 is rectified so as to be directed forward and, as a result of combustion of this air-gas mixture, a central flame that is largely elongated forward will be formed. As a result, the velocity of the central flame becomes larger than the surrounding flames that are formed by the combustion of the air-gas mixture ejected from the second flame holes 42 of smaller diameter than that of the first flame hole 41. Consequently, due to Bernoulli law, the surrounding flames will be attracted toward the central flame. As a consequence, as shown in FIG. 1, an aggregated flame Fa elongated forward is formed by the combination of the surrounding flames into the central flame, and the flames can be prevented from getting spread radially outward.

However, if the amount of protrusion of the first flame hole 41 beyond the front face of the front plate 4 is made large, the amount of heat to be inputted from the surrounding flames into a cylindrical section 41*a* of the first flame hole 41 becomes large, whereby backfiring is likely to occur. In this embodiment, on the other hand, there is disposed a hole-free portion 53 between the first ventilation hole 51 and the second ventilation holes 52 in the rear plate 5. Due to this arrangement, the flow of the air-gas mixture from the first ventilation hole 51 toward the first flame hole 41 comes to be less influenced by the flow of the air-gas mixture that enters from the second ventilation holes 52. As a result, the air-gas mixture comes to flow substantially straight from the first ventilation hole 51 toward the first flame hole 41. That means, even if the amount of protrusion of the first ventilation hole 41 beyond the front face of the front plate 4 is made smaller, the flow of the air-gas mixture ejected from the first flame hole 41 will be rectified so as to be directed forward and, as a result, there can be obtained an effect of preventing the spreading of the flames in the radially outward direction. Accordingly, the amount of protrusion of the first flame hole 41 beyond the front face of the front plate 4 can be made small to the extent possible, and the backfiring due to overheating of the first flame hole 41 can be prevented.

In addition, according to this embodiment, the second ventilation holes 52 are formed in that portion of the rear plate 5 which is positioned radially outward of the inner coaxial circle $C_1$. Therefore, the flow of the air-gas mixture that is directed from the second ventilation holes 52 toward the second flame holes 42 that are located on the inner coaxial circle $C_1$ is inclined radially inward. As a result, the air-gas mixture can be prevented from being ejected from the second ventilation holes 52 with a radially outward directional component. In this manner, the flames can more effectively be prevented from spreading radially outward.

In addition, due to the combustion of the air-gas mixture that is ejected at a relatively low speed from the flame retention holes 43 of relatively small opening area, there can be formed flames Fb that are hard to be lifted off, and flame retention properties can be secured.

Descriptions have so far been made of embodiments of this invention with reference to the accompanying drawings. This invention is, however, not limited to the above embodiments. For example, in the above embodiments, there was used a mixing tube 2 of sheet metal make. It is possible to use a mixing tube made in casting. Further, the flame retention holes 43 in the above embodiments may be omitted. Still furthermore, in the above-mentioned embodiments, this invention is applied to a tubular burner for heating appliances. This invention can, however, be applied to tubular burners which are used in a combustion apparatus other than for a heating appliance.

What is claimed is:

1. A tubular burner comprising:

a mixing tube inclusive of an inlet port, at a rear end thereof, into which a fuel gas and primary air flow, a venturi section having a smaller diameter than a diameter of the inlet port, and a tapered tube section having a gradually larger diameter from the venturi section toward a front of the mixing tube; and a flame hole member having a plurality of flame holes and being adapted to be fitted into a front end region of the mixing tube such that a mixture of the fuel gas and primary air is ejected from the flame holes for combustion, the flame hole member being made up of a front plate of sheet metal make, and a rear plate of sheet metal make located at a rear of the front plate, the front plate having a first flame hole in a central portion of the front plate, and a plurality of second flame holes located around a periphery of the first flame hole, the first flame hole defined by a cylindrical tube protruding beyond and extending in a substantially perpendicular direction from a part of a front face of the front plate, the rear plate having: a first ventilation hole in a center thereof so as to lie opposite to the first flame hole; and a plurality of second ventilation holes of smaller diameter than the first ventilation hole, the second ventilation holes being located toward a periphery of the rear plate at a predetermined radial distance from the first ventilation hole, wherein a hole-free portion is formed in such a portion of the rear plate as to be present between the first ventilation hole and the second ventilation holes, wherein the front plate and rear plate are spaced apart from each other and there are no plate between the front plate and the rear plate.

2. The tubular burner according to claim 1, wherein a plurality of the second flame holes are respectively formed on different-diameter circles which are coaxial with the first flame opening, and wherein a portion in which the second ventilation holes are formed in the rear plate is located radially outside the circle of smallest diameter among the coaxial circles.

3. The tubular burner according to claim 1, wherein the cylindrical tube is configured to protrude forward from a position of the front face of the front plate and the first flame hole is radially inward of the position in which the second flame holes are located.

* * * * *